US006547212B2

(12) United States Patent
Verdecchia

(10) Patent No.: US 6,547,212 B2
(45) Date of Patent: Apr. 15, 2003

(54) FLUSH VALVE

(75) Inventor: William A. Verdecchia, Erie, PA (US)

(73) Assignee: Zurn Industries, Inc., Erie, PA (US)

( * ) Notice: Subject to any disclaimer, the term of this patent is extended or adjusted under 35 U.S.C. 154(b) by 0 days.

(21) Appl. No.: 09/767,021

(22) Filed: Jan. 22, 2001

(65) Prior Publication Data

US 2001/0028048 A1 Oct. 11, 2001

Related U.S. Application Data

(60) Provisional application No. 60/177,858, filed on Jan. 24, 2000.

(51) Int. Cl.[7] ..... F16K 31/12
(52) U.S. Cl. ..... 251/40; 251/120
(58) Field of Search ..... 251/40, 38, 120; 137/550

(56) References Cited

U.S. PATENT DOCUMENTS 1,937,044 A * 11/1933 Miller ..... 181/234
2,433,507 A * 12/1947 Delany ..... 251/120
3,279,742 A * 10/1966 Billeter ..... 251/214
3,399,860 A * 9/1968 Billeter et al. ..... 251/121
3,656,499 A 4/1972 Nelson et al.
4,261,545 A * 4/1981 Allen ..... 138/40
5,013,007 A 5/1991 Whiteside
5,150,877 A 9/1992 Whiteside et al.
5,232,194 A 8/1993 Saadi et al.
5,332,192 A 7/1994 Whiteside
5,335,694 A 8/1994 Whiteside
5,415,374 A * 5/1995 Carroll et al. ..... 251/40
5,865,420 A 2/1999 Wilson
5,887,848 A 3/1999 Wilson
6,182,689 B1 * 2/2001 Lauer et al. ..... 137/550
6,216,730 B1 * 4/2001 Hall ..... 137/550

* cited by examiner

*Primary Examiner*—Kevin Shaver
*Assistant Examiner*—David A Bonderer
(74) *Attorney, Agent, or Firm*—Webb Ziesenhiem Logsdon Orkin & Hanson P C

(57) ABSTRACT

A refill ring for a flush valve that is attached to a guide member of a valve assembly and is positioned for contact with a passage of the flush valve is described. The refill ring includes an annular-shaped solid resilient member, such as an O-ring. The refill ring is received on the guide member. Alternatively, the refill ring can be integrally formed on an underside of the diaphragm.

38 Claims, 3 Drawing Sheets

FLUSH VALVE

CROSS-REFERENCE TO RELATED APPLICATION

This application claims the benefit of U.S. Provisional Patent Application bearing Ser. No. 60/177,858 filed Jan. 24, 2000.

BACKGROUND OF THE INVENTION

1. Field of the Invention

The present invention relates to flush valves of the type commonly found in public washrooms and, more particularly, to a refill ring.

2. Description of the Prior Art

U.S. Pat. Nos. 3,656,499; 5,013,007; 5,150,877; 5,232,194; 5,332192; 5,335,694; and 5,865,420 show various types of refill rings. Typically, these refill rings have passageways to permit water to pass therethrough during the closing process. The purpose of the refill rings is two-fold; namely, to limit the amount of water passing through diaphragm-type flush valves during closing and to avoid vibration and noise. However, all of these refill rings are expensive to manufacture and do not adequately perform their intended function. Therefore, it is an object of the present invention to provide a flush valve refill ring to overcome the deficiencies of the prior art.

SUMMARY OF THE INVENTION

The present invention is a flush valve that includes a body having an inlet and an outlet, a passage connecting the inlet and outlet, a valve seat on one end of the passage, a valve assembly in the body including a relief valve and a flexible diaphragm having a sealing surface configured to have a pressure difference applied across the valve and positioned to control the flow of water through the passage and to close upon the seat, a guide member extending from the underside of the diaphragm and configured to co-act with the passage, and a refill ring attached to the guide member and positioned for contact with the passage. The refill ring includes an annular-shaped solid resilient member. An example of such a member is an O-ring made of rubber or other flexible polymeric material. During operation, when the valve assembly is in an open position, the refill ring does not contact the passage. However, during closing operation of the valve assembly, but before seating on the valve seat, the refill ring forms an initial seal between the passage and the guide member so that water cannot pass therethrough. Moreover, the refill ring provides yielding frictional resistance to the movement of the valve assembly relative to the passage to thereby dampen vibration of the valve assembly during the closing phase of the flush valve operating cycle. The refill ring is received on a supporting member, preferably, a shoulder defined by the guide member and an annular member, attached to the guide member whereby the refill ring contacts both the valve assembly and the passage when the valve assembly is in the closed position. Preferably, the support member is configured so that it does not contact the passage during the closing phase of the flush valve operation. Alternatively, the refill ring can be integrally formed on an underside of the diaphragm.

The present invention is also a flush valve of the described type having a flow control ring attached to the guide member. The flow control ring is held in position by a plurality of guide member legs extending from the guide member and preferably a second support member. The flow control ring includes an annular-shaped solid resilient member. Again, an example of such a member is an O-ring made of rubber or other flexible polymeric material. The flow control ring is positioned on the guide member so that it is in constant contact with the passage during the entire stroke or operating cycle of the flush valve. The flow control ring provides yielding frictional resistance to the movement of the valve assembly relative to the passage to thereby dampen vibration of the valve assembly during the entire flush valve operating cycle. However, the arrangement of the flow control ring, the plurality of guide member legs and guide member is such that gaps are formed to allow for the flow of water through the passage during the flush valve operation. Preferably, the second support member is configured so that it does not contact the passage during the stroke of the valve assembly during flush valve operation.

DESCRIPTION OF THE PREFERRED EMBODIMENTS

As detailed in the above-described patents, there have in the past been numerous attempts to improve flush valve performance by focusing on the structure and design of the refill ring. The refill ring controls the flow of water through the closing portion of the flush valve operating cycle. A problem that has been consistent with previous flush valve designs, and the refill rings therein, is the noise caused by abrupt change in water flow through the valve, which noise is caused at least in part by the free vibration of the valve assembly. Prior attempts to solve this problem were directed to varying the mass of the valve assembly to dampen the vibrations or other types of ring arrangements to solve the noise problems. Recently, tiny passageways or grooves were added to the refill ring in an attempt to solve the problem. However, refill rings having such passageways or grooves were unsuccessful in solving the noise problem.

Figure 1:
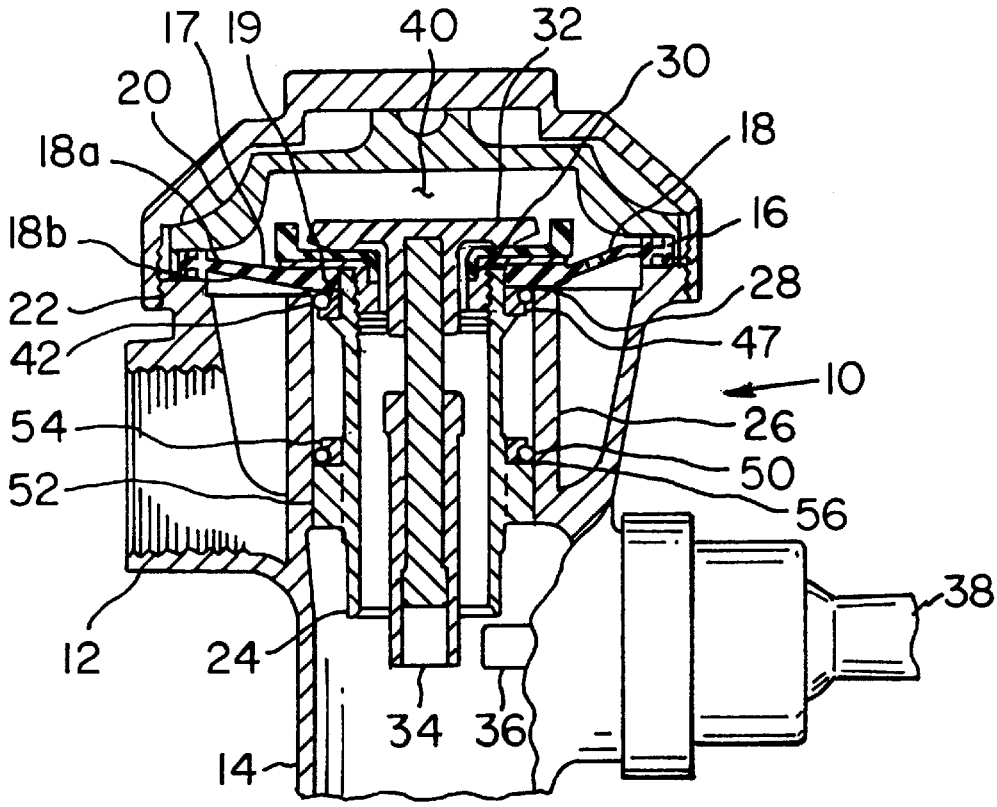
FIG. 1 is a partial axial section through a flush valve of the type described, showing the improved refill ring and flow control ring of the present invention.

FIG. 1 shows a flush valve body 10 that has an inlet 12 and an outlet 14. The valve assembly is indicated generally at 16 and includes a flexible diaphragm 18 clamped about its periphery between an internal cover 20 and a shoulder 22 formed in the flush valve body 10. A guide member 24 is attached to an inner edge of the diaphragm 18 and extends within a passage 26 of the flush valve, the passage 26 forming a passageway between the inlet 12 and the outlet 14. The top of the passage 26 defines a valve seat 28 upon which a valve assembly 16 closes.

The valve assembly 16 is provided with a central opening 30, above which a relief valve 32 rests. The valve assembly 16 includes a diaphragm 18 having a first side 18*a* and a second side 18*b* and defines an orifice 17 extending from the first side 18*a* to the second side 18*b*. The diaphragm 18 has a sealing surface 19 on the second side 18*b* that is adjacent to an inner edge of the diaphragm 18. The diaphragm 18 has a mounting portion at a peripheral edge for mounting the valve assembly within the flush valve. The lower end of relief valve 32, indicated at 34, is unseated when contacted by plunger 36 during the operation cycle of the flush valve. As is well-known in the art, plunger 36 is operated by movement of the handle 38. There is a pressure chamber 40 above the valve assembly 16 that functions to hold the entire valve assembly 16 upon the seat 28 until the chamber 40 is vented by relief valve 32 during the initiation of the operating cycle.

The stroke of the valve assembly 16, which may determine the volume of water flowing through the flush valve during operation, is fixed by the positions of the relief valve 32 relative to the plunger 36 and the internal cover 20. Movement of the plunger 36, caused by movement of the handle 38, unseats the relief valve 32 venting the pressure in chamber 40 above the valve assembly 16. The diaphragm 18 has sufficient flexibility to allow the valve assembly 16 to move up a distance whereby the lower end 34 of the relief valve 32 clears plunger 36. The relief valve 32 will then return to its closed vertical position as shown in FIG. 1, and the upward stroke of the valve assembly 16 will be completed. The valve assembly 16 will then start to move downward toward the closed position, as shown in FIG. 1. The stroke of the valve assembly 16 determines the time period during which water will flow through the flush valve, but since the diaphragm 18 is made of rubber or suitable polymeric material, it is not desirable to unduly stretch it. For this reason, it is preferred to limit the stroke of the valve assembly 16, yet be able to control water flow to comply with various governmental standards regarding the volume per flush valve operation.

It is also desirable to limit vibration of the diaphragm 18 during the closing portion of the flush valve operating cycle, which vibrations cause unacceptable noise. In addition to reducing the level of noise during flush valve operation, the present invention provides a more precise control of the flow of water through the flush valve during the closing phase of the flush valve operation cycle, typically referred to as the refill phase, in which the toilet bowl or urinal to which the flush valve is attached is being partially filled with water.

The refill ring of the present invention is also specifically designed to provide the consistent flow of water during the operation of the flush valve even though the passage 26 may have a range of diameters due to manufacturing tolerances inherent in any machine part. U.S. Pat. No. 5,865,420 attempted to solve this problem by utilizing an inverted, U-shaped refill ring. However, this U-shaped refill ring is expensive to make and does not adequately solve the noise problem.

Figure 2:
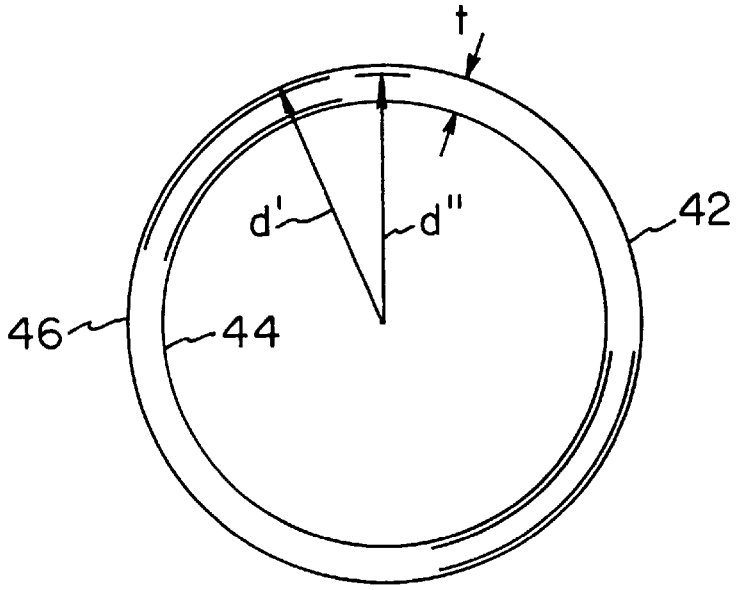
FIG. 2 is a top view of the refill ring shown in FIG. 1.
Figure 3:
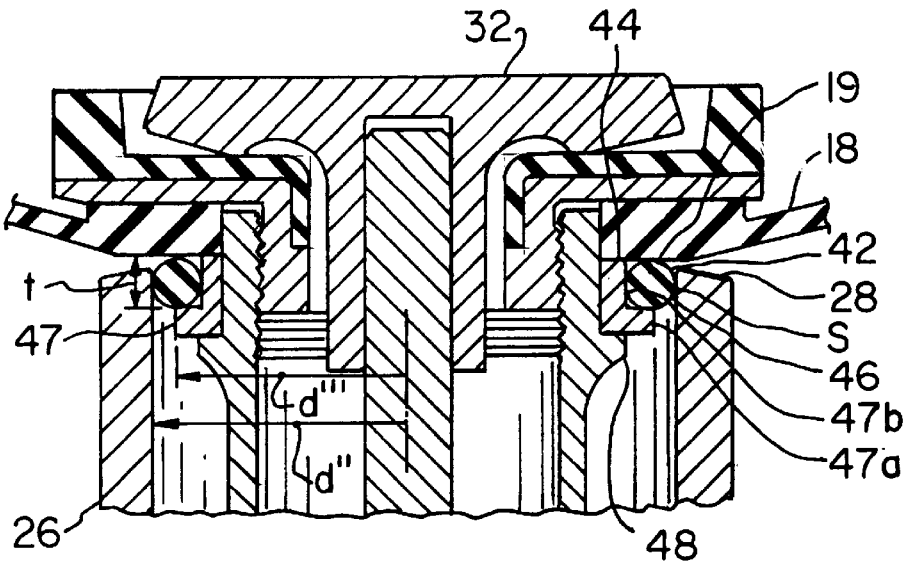
FIG. 3 is a partial section illustrating the relationship between the refill ring, a diaphragm and a passage of the flush valve shown in FIG. 1.
Figure 4:
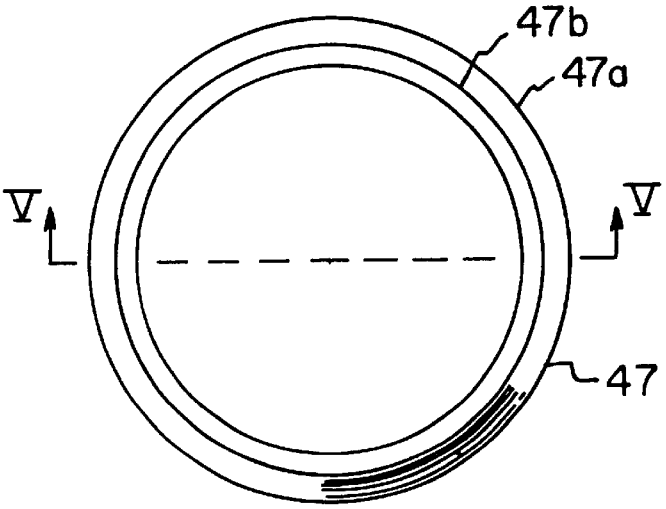
FIG. 4 is a top view of a refill ring support member shown in FIG. 1.
Figure 5:
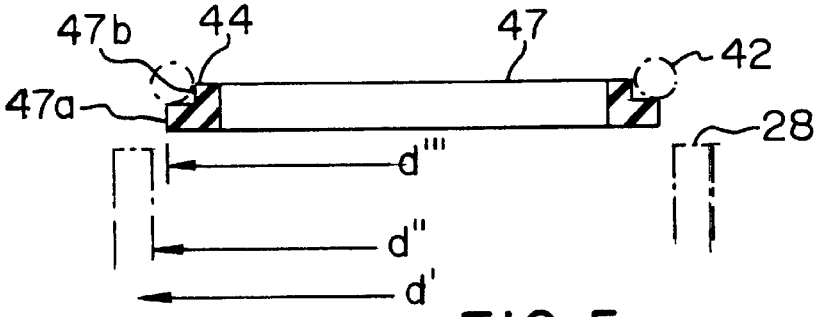
FIG. 5 is a cross-sectional view of the refill ring support member shown in FIG. 4 along line V—V with the refill ring and passage shown in phantom.

In contrast, the Applicant's invention includes a refill ring 42, as shown in FIG. 2, which is generally circular in cross-section, and is preferably an O-ring. The refill ring 42 is preferably formed from rubber or other polymeric materials that are resilient and flexible. The refill ring 42 includes an inner surface 44 and an outer surface 46. A bottom of the refill ring 42 is held in position by an annular member 47, as shown in FIGS. 1 and 4. The annular member 47 has an L-shaped cross-section, as shown in FIG. 5. The annular member 47 is, in turn, supported by a shoulder 48 defined by the outer surface of guide member 24, as shown in FIG. 3. Accordingly, the refill ring 42 is held in place or sandwiched by the sealing surface 19 and the annular member 47.

As shown in FIGS. 4 and 5, the annular member 47 includes a first annular portion 47*a* connected to a depending second annular portion 47*b*. The inner surface 44 of the refill ring 42 contacts the depending second annular portion 47*b* and a bottom of refill ring is supported by annular member 47, as shown in FIG. 5. The nominal diameter, thickness and durometer value of the material used to make the refill ring 42 are determined on a case-by-case basis. Both the geometrical features and the durometer value of the material used to make the refill ring 42 affect its flexibility and resiliency. The refill ring 42 should be compressed enough to provide for sufficient damping and timing. Preferably, the refill ring 42 has a circular cross-section where "t" is the diameter of the circular cross-section as shown in FIGS. 2 and 3. The flexibility and resiliency of the refill ring 42 determines the duration during which water flows through the gap defined by the passage 26 and the outer surface 46 of the refill ring 42, as the refill ring 42 moves to its fully closed position. Preferably, the passage 26 is smooth where the refill ring 42 contacts it. As shown in FIGS. 2, and 5, the outer diameter of the refill ring 42 in its uncompressed state d' will be slightly greater than the inner diameter d" of the passage 26. Consequently, refill ring 42 is slightly compressed during the operation of the flush valve, resulting in yielding frictional resistance to the movement of refill ring 42, thus minimizing valve assembly vibration, as the valve assembly 16 moves to its fully closed position.

During the final stage of the stroke of valve assembly 16, the cross-sectional area of the refill ring 42 is squeezed between annular member 47 and passage 26, imparting an elliptical shape thereto. The actual bearing surface area S, as shown in FIG. 3, between the outer surface 46 of the refill ring 42 and the inner wall of the passage 26 is very small. The bearing surface area S provides the necessary frictional load to dampen vibration of the diaphragm 18 as the valve assembly 16 moves to its filly closed position. The bearing surface area S reduces the contact stress between the sealing surface of the diaphragm 19 and the seat 28 and contributes to consistent performance of the valve assembly 16 during product life. Preferably, the outer diameter d"'. of the first annular portion 47*a* of annular member 47, as shown in FIGS. 3 and 5, is less than the diameter d" of the passage 26, so that annular member 47 does not contact the passage 26 during the stroke of the valve assembly 16. The flexible diaphragm 18 finally forms a liquid seal on the valve seat 28 in the closed position and the refill ring forms a liquid seal with the bearing surface area S. The refill ring provides the first or initial liquid seal between the passage and the guide member during the closing process so that water cannot pass therethrough and then the diaphragm 18 seats on the valve seat for forming a second liquid seal when the valve is closed or completely seated. This provides a flush valve also with two seals in the closed position.

Figure 6:
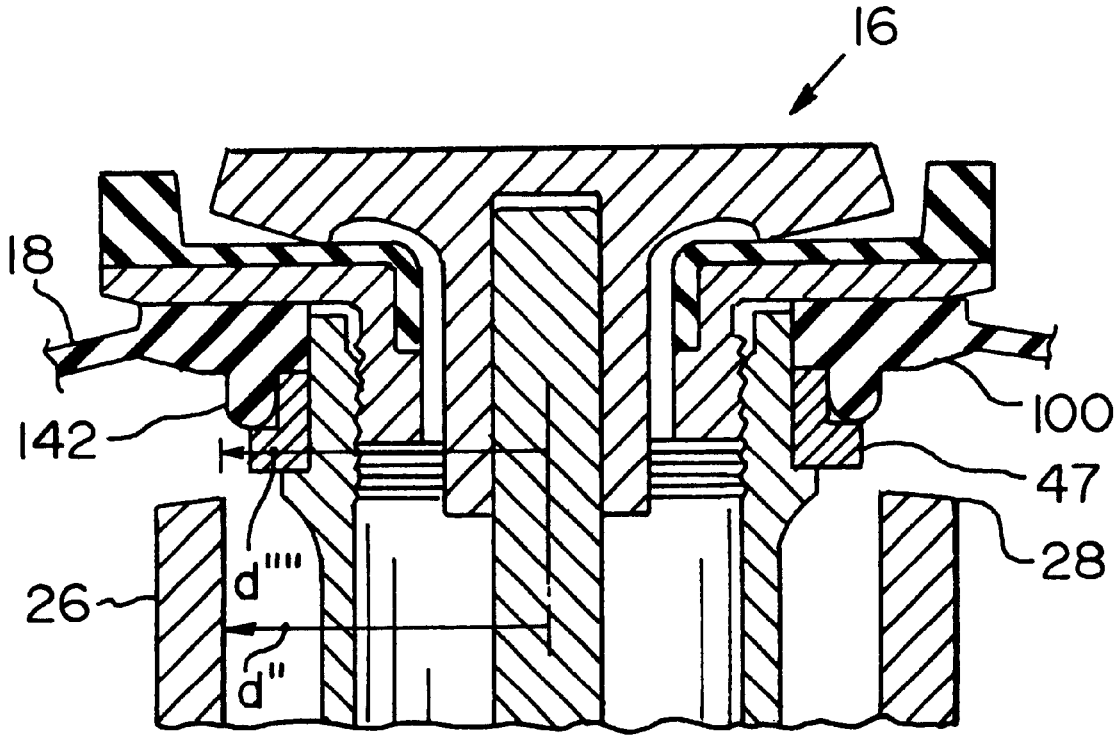
FIG. 6 is a partial axial sectional view through a flush valve of the type described of another embodiment of the present invention.

FIG. 6 shows a second embodiment of the present invention. The invention is similar to the previously described first embodiment and, therefore, like reference numerals are used for like elements. It also shows the valve assembly 16 in an open position relative to the seat 28 at the top of passage 26 such that water can flow through the gap formed by the passage 26 and the valve assembly 16. Specifically, FIG. 6 shows the second embodiment wherein a resilient member is integrally formed on a bottom surface 100 of the diaphragm 18. In this case, the diaphragm 18 includes a unitary refill ring sealing member 142. Similar to refill ring 42, the outer diameter d"" of sealing member 142 is slightly greater than the inner diameter d" of the passage 26, again resulting in yielding frictional resistance to the movement of sealing member 142, thus minimizing valve assembly vibration as the valve assembly 16 moves to its fully closed position. A bottom of the sealing member 142 is held in position by an annular member 47. The diaphragm 18 and sealing member 142 of this embodiment operate in the same manner as the embodiment previously described.

As shown in FIG. 1, the present invention also includes a resilient flow control ring 50. The balance of the invention is similar to the embodiments previously described and, therefore, like reference numerals are used for like elements. The flow control ring 50 is held in position between a plurality of guide member legs 52 and a second annular member 54. The guide member legs 52 are similar to the outwardly extending radial wing members as shown as reference element 38 of FIG. 1 in U.S. Pat. No. 5,232,194, which is hereby incorporated by reference. Preferably, the flow control ring 50 is a resilient O-ring made of the same material and having the same relative dimensions as refill ring 42. An outer surface 56 of the flow control ring 50 is in constant contact with an inner surface of the passage 26 during the stroke of the valve assembly 16. Although flow control ring 50 is in constant contact with an inner surface of the passage 26, the guide member legs 52 and the second annular member 54 are configured such that water can flow through the gaps defined by the inner edge of the second annular member 54, the exterior of the guide member and the guide member legs 52, during the operation of the flush valve. Preferably, the outer diameter of flow control ring 50 is slightly larger than the inner diameter of the passage 26, which is in turn slightly larger than the outer diameter of the second annular member 54. Consequently, flow control ring 50 is slightly compressed during the operation of the flush valve, without second annular member 54 contacting the passage, resulting in yielding frictional resistance to the movement of the flow control ring 50, thus minimizing valve assembly vibration during the entire stroke of the valve assembly 16.

The present invention provides a very quiet operating flush valve and is inexpensive to manufacture. Having described the currently preferred embodiments of the present invention, it is to be understood that the invention may be otherwise embodied within the scope of the appended claims.

I claim:

1. A flush valve, comprising:

a body having an inlet and outlet;

a passage connecting said inlet and outlet;

a valve seat at one end of the passage;

a valve assembly in said body including a diaphragm, said valve assembly positioned to control the flow of water through said passage and to close upon said seat;

a guide member extending from the underside of said valve assembly and configured to co-act with said passage, said guide member defining a shoulder;

a refill ring co-acting with said guide member and positioned for contact with said passage;

and an annular member configured to support and co-act with said refill ring, wherein said refill ring comprises a resilient solid ring providing yielding frictional resistance to movement of said valve assembly relative to said passage to thereby dampen vibration of said valve assembly during a closing phase of the flush valve operating cycle and control the flow of water through the flush valve, and wherein the annular member is positioned adjacent to and held in place by the shoulder, and the refill ring is held in position between the annular member and said valve assembly.

2. The apparatus of claim 1, wherein the refill ring is an O-ring made from at least one of rubber and polymeric material.

3. The apparatus of claim 1, wherein the refill ring is integrally formed on an underside of said diaphragm.

4. The apparatus of claim 1, wherein the guide member is positioned within said passage and the refill ring positioned to co-act with the exterior of said guide member.

5. The apparatus of claim 1, wherein the annular member does not contact the passage during the flush valve operating cycle.

6. The apparatus of claim 1, further comprising:

a plurality of guide member legs attached to said guide member;

a second annular member attached to said guide member; and a resilient solid flow control ring, wherein the flow control ring is held in position between the plurality of guide member legs and the second annular member, and is configured to be in constant contact with said passage during the entire stroke of the valve assembly during the operation of the flush valve, whereby the flow control ring provides yielding frictional resistance to movement of said valve assembly relative to said passage to thereby dampen vibration of said valve assembly during the entire flush valve operating cycle.

7. The apparatus of claim 6, wherein the second annular member does not contact the passage during the flush valve operating cycle.

8. The apparatus of claim 6, wherein the guide member is positioned within said passage and the refill ring is positioned to co-act with the exterior of said guide member, the refill ring comprising an O-ring made from at least one of rubber and polymeric material, the refill ring held in place between an annular member co-acting with an exterior of said guide member and said diaphragm of said valve assembly and the flow control ring comprising an O-ring made from at least one of rubber and polymeric material, the plurality of guide member legs depending from the exterior of said guide member, the flow control ring held in place between the second annular member co-acting with the exterior of said guide member and the guide member legs.

9. The apparatus of claim 8, wherein the refill ring is integrally formed on an underside of said diaphragm.

10. A flush valve, comprising:

a valve body defining an inlet connection and an outlet connection;

a valve assembly positioned in the valve body and separating the inlet connection and the outlet connection, with the valve assembly configured to have a pressure difference applied across the valve assembly and positioned to control the flow of water through the valve body;

the valve assembly comprising:

an annular flexible diaphragm having a mounting portion at a peripheral edge for mounting the valve assembly within the flush valve, the diaphragm having a first side and a second side and defining an orifice extending from the first side to the second side and a sealing surface on the second side and adjacent to an inner edge of the diaphragm and an annular guide member having two ends, said guide member defining a shoulder, the first end attached to an inner edge of the diaphragm adjacent to the sealing surface and defining a relief valve seat and central opening, and the second end extending from the second side of the diaphragm;

a resilient solid refill ring attached to the exterior of the guide member abutting the sealing surface of the diaphragm;

an annular member configured to support and co-act with the refill ring;

a relief valve resting above and extending through the central opening of the guide member and configured to seal against the relief valve seat; and an elongated passage in fluid communication with the outlet connection, the passage having a distal end defining a valve seat configured to contact the sealing surface of the diaphragm, wherein a portion of the guide member is configured to travel within and relative to the passage during the operation of the flush valve, an operating cycle initiated by unseating the relief valve from the relief valve seat thereby venting the portion of the flush valve between the first side of the diaphragm and the valve body, and wherein the refill ring is positioned for contact with the interior of the passage and provides yielding frictional resistance to movement of the valve assembly relative to passage to thereby dampen vibration of said valve assembly during the closing portion of the flush valve operating cycle and control the flow of water through the flush valve; and wherein the annular member is positioned adjacent to and held in place by the shoulder, and the refill ring is held in position between the annular member and the sealing surface of the diaphragm.

11. The apparatus of claim 10, wherein the refill ring is an O-ring made from at least one of rubber and polymeric material.

12. The apparatus of claim 10, wherein the refill ring is integrally formed on the second side of the diaphragm.

13. The apparatus of claim 10, wherein the annular member does not contact the passage.

14. The apparatus of claim 10, further comprising:

a plurality of guide member legs depending from the exterior of the guide member;

a second annular member attached to the outer surface of the guide member; and a resilient solid flow control ring, wherein the flow control ring is held in position between the plurality of guide member legs and the second annular member, and is configured to be in constant contact with the passage during the entire stroke of the valve assembly during the operation of the flush valve, whereby the flow control ring provides yielding frictional resistance to movement of the valve assembly relative to the passage to thereby dampen vibration of said valve assembly during the entire flush valve operating cycle.

15. A valve assembly configured to co-act with a flush valve comprising:

an annular flexible diaphragm having a mounting portion at a peripheral edge for mounting the valve assembly within the flush valve, the diaphragm having a first side and a second side and defining an orifice extending from the first side to the second side and a sealing surface on the second side and adjacent to an inner edge of the diaphragm;

an annular guide member having two ends, the first end attached to the inner edge of the diaphragm adjacent to the sealing surface and defining a relief valve seat and central opening, and the second end extending from the second side of the diaphragm;

a plurality of guide member legs depending from the exterior of the guide member;

a second annular member attached to the outer surface of the guide member;

a resilient solid flow control ring; and a resilient solid refill ring attached to the exterior of the guide member abutting the sealing surface of the diaphragm;

wherein a portion of the guide member is configured to travel within and relative to a passage of the flush valve during the operation of the flush valve, wherein the refill ring is positioned for contact with the interior of the passage and provides yielding frictional resistance to movement of the valve assembly relative to the passage to thereby dampen vibration of said valve assembly during the closing portion of the flush valve operating cycle and control the flow of water through the flush valve, wherein the flow control ring is held in position between the plurality of guide member legs and the second annular member, and is configured to be in constant contact with the passage during the entire stroke of the valve assembly during the operation of the flush valve, the valve assembly relative to the passage to thereby dampen vibration of said valve assembly whereby the flow control ring provides yielding frictional resistance to movement of during the entire flush-valve operating cycle.

16. The apparatus of claim 15, wherein the refill ring is an O-ring made from at least one of rubber and polymeric material.

17. The apparatus of claim 15, wherein the refill ring is integrally formed on the second side of the diaphragm.

18. A flush valve, comprising:

a body having an inlet and outlet;

a passage connecting said inlet and outlet;

a valve seat at one end of the passage;

a valve assembly in said body including a diaphragm, said valve assembly positioned to control the flow of water through said passage and to close upon said seat;

a guide member extending from the underside of said valve assembly and configured to co-act with said passage;

a refill ring in the form of a resilient, flexible, solid O-ring co-acting with said guide member and positioned for contact with said passage, wherein said refill ring is positioned between said diaphragm and said shoulder.

19. The apparatus of claim 18, wherein the refill ring is made from at least one of rubber and polymeric material.

20. The apparatus of claim 18, wherein the refill ring is of a circular cross-section.

21. A flush valve, comprising:

a valve body defining an inlet connection and an outlet connection;

a valve assembly positioned in the valve body and separating the inlet connection and the outlet connection, with the valve assembly configured to have a pressure difference applied across the valve assembly and positioned to control the flow of water through the valve body;

the valve assembly comprising:

an annular flexible diaphragm having a mounting portion at a peripheral edge for mounting the valve assembly within the flush valve, the diaphragm having a first side and a second side and defining an orifice extending from the first side to the second side and a sealing surface on the second side and adjacent to an inner edge of the diaphragm and an annular guide member having two ends, the first end attached to an inner edge of the diaphragm and an annular guide member having two ends, the first end attached to an inner edge of the diaphragm adjacent to the sealing surface and defining a relief valve seat and central opening, and the second end extending from the second side of the diaphragm;

a resilient, flexible, solid refill ring attached to the exterior of the guide member abutting the sealing surface of the diaphragm;

a relief valve resting above and extending through the central opening of the guide member and configured to seal against the relief valve seat; and an elongated passage in fluid communication with the outlet connection, the passage having a distal end defining a valve seat configured to contact the sealing surface of the diaphragm, wherein a portion of the guide member is configured to travel within and relative to the passage during the operation of the flush valve, an operating cycle initiated by unseating the relief valve from the relief valve seat thereby venting the portion of the flush valve between the first side of the diaphragm and the valve body, and wherein the refill ring is an O-ring positioned for contact with the interior of the passage and provides yielding frictional resistance to movement of the valve assembly relative to passage to thereby dampen vibration of said valve assembly during the closing portion of the flush valve operating cycle and control the flow of water through the flush valve.

22. The apparatus of claim 21, wherein the refill ring is an O-ring made from at least one of rubber and polymeric material.

23. The apparatus of claim 21, wherein the refill ring is of a circular cross-section.

24. A valve assembly configured to co-act with a flush valve comprising:

an annular flexible diaphragm having a mounting portion at a peripheral edge for mounting the valve assembly within the flush valve, the diaphragm having a first side and a second side and defining an orifice extending from the first side to the second side and a sealing surface on the second side and adjacent to an inner edge of the diaphragm;

an annular guide member having two ends, the first end attached to the inner edge of the diaphragm adjacent to the sealing surface and defining a relief valve seat and central opening, and the second end extending from the second side of the diaphragm; and a resilient, flexible, solid refill ring attached to the exterior of the guide member abutting the sealing surface of the diaphragm, said refill ring is an O-ring, wherein a portion of the guide member is configured to travel within and relative to a passage of the flush valve during the operation of the flush valve, and wherein the refill ring is positioned for contact with the interior of the passage and provides yielding frictional resistance to movement of the valve assembly relative to the passage to thereby dampen vibration of said valve assembly during the closing portion of the flush valve operating cycle and control the flow of water through the flush valve.

25. The apparatus of claim 24, wherein the refill ring is made from at least one of rubber and polymeric material.

26. The apparatus of claim 24, wherein the refill ring is of a circular cross-section.

27. A flush valve, comprising:

a body having an inlet and outlet, a passage connecting said inlet and outlet;

a valve seat at one end of the passage, a valve assembly in said body including a diaphragm, said valve assembly positioned to control the flow of water through said passage and to close upon said seat;

a guide member extending from the underside of said valve assembly and configured to co-act with said passage;

and a refill co-acting with said guide member and positioned for contact with said passage, said refill ring in the form of a resilient, flexible, solid ring having a curved outer surface for co-acting with said guide member and positioned for contact with said passage, said refill ring is integral and depends from an underside of said diaphragm and has a solid cross-section, said ring providing yielding frictional resistance to movement of said valve assembly relative to said passage to thereby dampen vibration of said valve assembly during a closing phase of the flush valve operating cycle and control the flow of water through the flush valve.

28. The apparatus of claim 27, wherein the refill ring is made from at least one of rubber and polymeric material.

29. A flush valve, comprising:

a valve body defining an inlet connection and an outlet connection;

a valve assembly positioned in the valve body and separating the inlet connection and the outlet connection, with the valve assembly configured to have a pressure difference applied across the valve assembly and positioned to control the flow of water through the valve body;

the valve assembly comprising:

an annular flexible diaphragm having a mounting portion at a peripheral edge for mounting the valve assembly within the flush valve, the diaphragm having a first side and a second side and defining an orifice extending from the first side to the second side and a sealing surface on the second side and adjacent to an inner edge of the diaphragm and an annular guide member having two ends, the first end attached to an inner edge of the diaphragm adjacent to the sealing surface and defining a relief valve seat and central opening, and the second end extending from the second side of the diaphragm;

a resilient, flexible, refill ring;

a relief valve resting above and extending through the central opening of the guide member and configured to seal against the relief valve seat; and an elongated passage in fluid communication with the outlet connection, the passage having a distal end defining a valve seat configured to contact the sealing surface of the diaphragm, wherein a portion of the guide member is configured to travel within and relative to the passage during the operation of the flush valve, an operating cycle initiated by unseating the relief valve from the relief valve seat thereby venting the portion of the flush valve between the first side of the diaphragm and the valve body, and wherein the refill ring is integral and depends from the underside of the diaphragm and has a solid cross-section with a curved outer surface and is positioned for contact with the interior of the passage and provides yielding frictional resistance to movement of the valve assembly relative to passage to thereby dampen vibration of said valve assembly during the closing portion of the flush valve operating cycle and control the flow of water through the flush valve.

30. The apparatus of claim 29, wherein the refill ring is made from at least one of rubber and polymeric material.

31. A valve assembly configured to co-act with a flush valve comprising:

an annular flexible diaphragm having a mounting portion at a peripheral edge for mounting the valve assembly within the flush valve, the diaphragm having a first side and a second side and defining an orifice extending from the first side to the second side and a sealing surface on the second side and adjacent to an inner edge of the diaphragm;

an annular guide member having two ends, the first end attached to the inner edge of the diaphragm adjacent to the sealing surface and defining a relief valve seat and central opening, and the second end extending from the second side of the diaphragm; and a resilient, flexible, refill ring wherein a portion of the guide member is configured to travel within and relative to a passage of the flush valve during the operation of the flush valve, and wherein the refill ring is integral and depends from underside of the diaphragm and has a solid cross-section with a curved outer surface and is positioned for contact with the interior of the passage and provides yielding frictional resistance to movement of the valve assembly relative to the passage to thereby dampen vibration of said valve assembly during the closing portion of the flush valve operating cycle and control the flow of water through the flush valve.

32. The apparatus of claim 31, wherein the refill ring is made from at least one of rubber and polymeric material.

33. A flush valve, comprising:

a body having an inlet and an outlet;

a passage connecting said inlet and outlet;

a valve seat at one end of the passage;

a valve assembly in said body including a diaphragm, said valve assembly positioned to control the flow of water through said passage and to close upon said seat;

a guide member extending from the underside of said valve assembly and configured to co-act with said passage;

a refill ring attached to said guide member and positioned for contact with said passage, the refill ring comprises a resilient solid ring providing yielding frictional resistance to movement of said valve assembly relative to said passage to thereby dampen vibration of said valve assembly during the closing phase of the flush valve operating cycle and control the flow of water through the flush valve;

a plurality of guide member legs attached to said guide member;

a second annular member attached to said guide member; and a flow control ring, wherein the flow control ring is held in position between the plurality of guide member legs and the second annular member, and is configured to be in constant contact with said passage during the entire stroke of the valve assembly during the operation of the flush valve, whereby the flow control ring provides yielding frictional resistance to movement of said valve assembly relative to said passage to thereby dampen vibration of said valve assembly during the entire flush valve operating cycle.

34. The apparatus of claim 33, wherein the second annular member does not contact the passage during the flush valve operating cycle.

35. The apparatus of claim 33, wherein the guide member is positioned within said passage and the refill ring is positioned to co-act with the exterior of said guide member, the refill ring comprising an O-ring made from at least one of rubber and polymeric material, the refill ring held in place between an annular member co-acting with an exterior of said guide member and said diaphragm of said valve assembly and the flow control ring comprising an O-ring made from at least one of rubber and polymeric material, the plurality of guide member legs depending from the exterior of said guide member, the flow control ring held in place between the second annular member co-acting with the exterior of said guide member and the guide member legs.

36. The apparatus of claim 35; wherein the refill ring is integrally formed on an underside of said diaphragm.

37. A flush valve, comprising:

a valve body defining an inlet connection and an outlet connection;

a valve assembly positioned in the valve body and separating the inlet connection and the outlet connection, with the valve assembly configured to have a pressure difference applied across the valve assembly and positioned to control the flow of water through the valve body;

the valve assembly comprising:

an annular flexible diaphragm having a mounting portion at a peripheral edge for mounting the valve assembly within the flush valve, the diaphragm having a first side and a second side and defining an orifice extending from the first side to the second side and a sealing surface on the second side and adjacent to an inner edge of the diaphragm and an annular guide member having two ends, the first end attached to an inner edge of the diaphragm adjacent to the sealing surface and defining a relief valve seat and central opening, and the second end extending from the second side of the diaphragm;

a resilient solid refill ring attached to the exterior of the guide member abutting the sealing surface of the diaphragm;

a relief valve resting above and extending through the central opening of the guide member and configured to seal against the relief valve seat;

an elongated passage in fluid communication with the outlet connection, the passage having a distal end defining a valve seat configured to contact the sealing surface of the diaphragm, wherein a portion of the guide member is configured to travel within and relative to the passage during the operation of the flush valve, an operating cycle initiated by unseating the relief valve from the relief valve seat thereby venting the portion of the flush valve between the first side of the diaphragm and the valve body, wherein the refill ring is positioned for contact with the interior of the passage and provides yielding frictional resistance to movement of the valve assembly relative to passage to thereby dampen vibration of said valve assembly during the closing portion of the flush valve operating cycle and control the flow of water through the flush valve;

a plurality of guide member legs depending from the exterior of the guide member;

a second annular member attached to the outer surface of the guide member; and a resilient solid flow control ring, wherein the flow control ring is held in position between the plurality of guide member legs and the second annular member, and is configured to be in constant contact with the passage during the entire stroke of the valve assembly during the operation of the flush valve, whereby the flow control ring provides yielding frictional resistance to movement of the valve assembly relative to the passage to thereby dampen vibration of said valve assembly during the entire flush valve operating cycle.

38. The apparatus of claim 37, wherein the annular member does not contact the passage.

* * * * *

UNITED STATES PATENT AND TRADEMARK OFFICE

CERTIFICATE OF CORRECTION

PATENT NO. : 6,547,212 B2
DATED : April 15, 2003
INVENTOR(S) : William A. Verdecchia It is certified that error appears in the above-identified patent and that said Letters Patent is hereby corrected as shown below:

Column 4,
Line 40, “d”’.” should read -- d”’ --.

Column 12,
Line 27, “35;” should read -- 35, --.

Signed and Sealed this

Twenty-third Day of September, 2003

JAMES E. ROGAN
*Director of the United States Patent and Trademark Office*